US007043176B1

(12) United States Patent
DeHollander et al.

(10) Patent No.: US 7,043,176 B1
(45) Date of Patent: May 9, 2006

(54) APPARATUS AND METHOD FOR DAMPING A CORONA WIRE IN AN ELECTROGRAPHIC PRINTER

(75) Inventors: Douglas William DeHollander, Clarkson, NY (US); Gary Bruce Bertram, Mendon, NY (US); Daniel Richard Palmer, Ogden, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/668,938

(22) Filed: Sep. 23, 2003

Related U.S. Application Data

(60) Provisional application No. 60/413,805, filed on Sep. 26, 2002.

(51) Int. Cl.
*G03G 15/02* (2006.01)

(52) U.S. Cl. ..... 399/170

(58) Field of Classification Search ..... 399/170, 399/100, 172, 101, 171
See application file for complete search history.

(56) References Cited

U.S. PATENT DOCUMENTS

| | | | | |
|---|---|---|---|---|
| 3,656,021 | A | 4/1972 | Furuichi et al. | |
| 3,842,273 | A | 10/1974 | Van Buskirk | |
| 4,038,546 | A | 7/1977 | Jasinski | |
| 4,109,289 | A | 8/1978 | Kuge et al. | |
| 4,408,865 | A * | 10/1983 | Camis et al. | 399/170 |
| 4,566,777 | A * | 1/1986 | Honda et al. | 399/100 |
| 4,652,754 | A | 3/1987 | Almeter et al. | |
| 5,170,314 | A | 12/1992 | Saito | |
| 5,182,694 | A | 1/1993 | Endo | |
| 5,392,099 | A | 2/1995 | Kusumoto et al. | |
| 5,485,255 | A | 1/1996 | Reuschle et al. | |
| 5,594,532 | A | 1/1997 | Tuvesson et al. | |
| 5,697,019 | A | 12/1997 | Kim | |
| 5,940,656 | A | 8/1999 | Hensel | |
| 6,108,504 | A | 8/2000 | Dickhoff | |
| 6,163,664 | A | 12/2000 | Hayash | |
| 6,294,782 | B1 | 9/2001 | Dickhoff | |
| 6,303,933 | B1 | 10/2001 | Dickhoff | |
| 6,328,250 | B1 | 12/2001 | Dickhoff | |
| 6,580,885 | B1 * | 6/2003 | Walgrove et al. | 399/100 |
| 6,819,893 | B1 * | 11/2004 | Kikuchi | 399/100 |
| 2003/0013443 | A1 * | 1/2003 | Willars et al. | 455/432 |

FOREIGN PATENT DOCUMENTS

| | | | |
|---|---|---|---|
| DE | 19606818 | A1 * | 8/1997 |
| GB | 2156165 | A * | 10/1985 |
| JP | 54104833 | A * | 8/1979 |
| JP | 61-140963 | | 6/1986 |
| JP | 1-100571 | | 4/1989 |
| JP | 2-134655 | | 5/1990 |
| JP | 03048871 | A * | 3/1991 |
| JP | 03089267 | A * | 4/1991 |
| JP | 3-267957 | | 11/1991 |
| JP | 5-323772 | | 12/1993 |
| JP | 7-271157 | | 10/1995 |
| JP | 07-302676 | A | 11/1995 |

(Continued)

*Primary Examiner*—Quana Grainger
(74) *Attorney, Agent, or Firm*—Donna P. Suchy

(57) ABSTRACT

The present invention is in the field of electrographic printers (including copiers). More specifically this invention relates to a corona charging device used to charge the surface of a photoconductor. At least one wire in a corona charger in an electrographic printer is damped by contacting the wire with a damping pad. In one preferred embodiment, the damping pad is a foamed silicone elastomer.

5 Claims, 3 Drawing Sheets

FOREIGN PATENT DOCUMENTS

| | | | | |
|---|---|---|---|---|
| JP | 09-160357 | | | 6/1997 |
| JP | 09311524 | A | * | 12/1997 |
| JP | 11-24375 | | | 1/1999 |
| JP | 11-249390 | A | | 9/1999 |
| JP | 11-338265 | | | 12/1999 |
| JP | 2001005259 | A | * | 1/2001 |
| JP | 2001350328 | A | | 12/2001 |

* cited by examiner

APPARATUS AND METHOD FOR DAMPING A CORONA WIRE IN AN ELECTROGRAPHIC PRINTER

This application claims the benefit of prior provisional patent application Ser. No. 60/413,805 of the same title and filed on Sep. 26, 2002.

BACKGROUND

The present invention is in the field of electrographic printers (including copiers). More specifically this invention relates to the corona charging device used to charge the surface of a photoconductor.

In electrography, a corona charging device may be employed to charge the surface of a photoconductor. Exemplary devices are disclosed by U.S. Pat. Nos. 5,485,255 and 5,424,540. The charging device may contain one or more small diameter (eg. 0.003 inch diameter) corona wires. It is important that these wires be properly tensioned. Excessive tension can result in wire breakage, whereas insufficient tension can result in wire vibration and subsequent non-uniform charging of the photoconductor, or arcing between the corona wire and adjacent grid. However, even when the wire is tensioned to the maximum, the displacement of the wire due to vibration can be unacceptable. The wire vibration is driven primarily by the corona current and can be linear or circular polarized (even chaotic) at higher current levels. Damping elements can absorb energy and limit vibration to an acceptable level.

SUMMARY OF THE INVENTION

An apparatus and method for damping at least one corona wire mounted to a charger body in an electrographic printer is provided, according to one aspect of the invention, comprising contacting said at least one corona wire with a damping pad.

DETAILED DESCRIPTION

Figure 1:
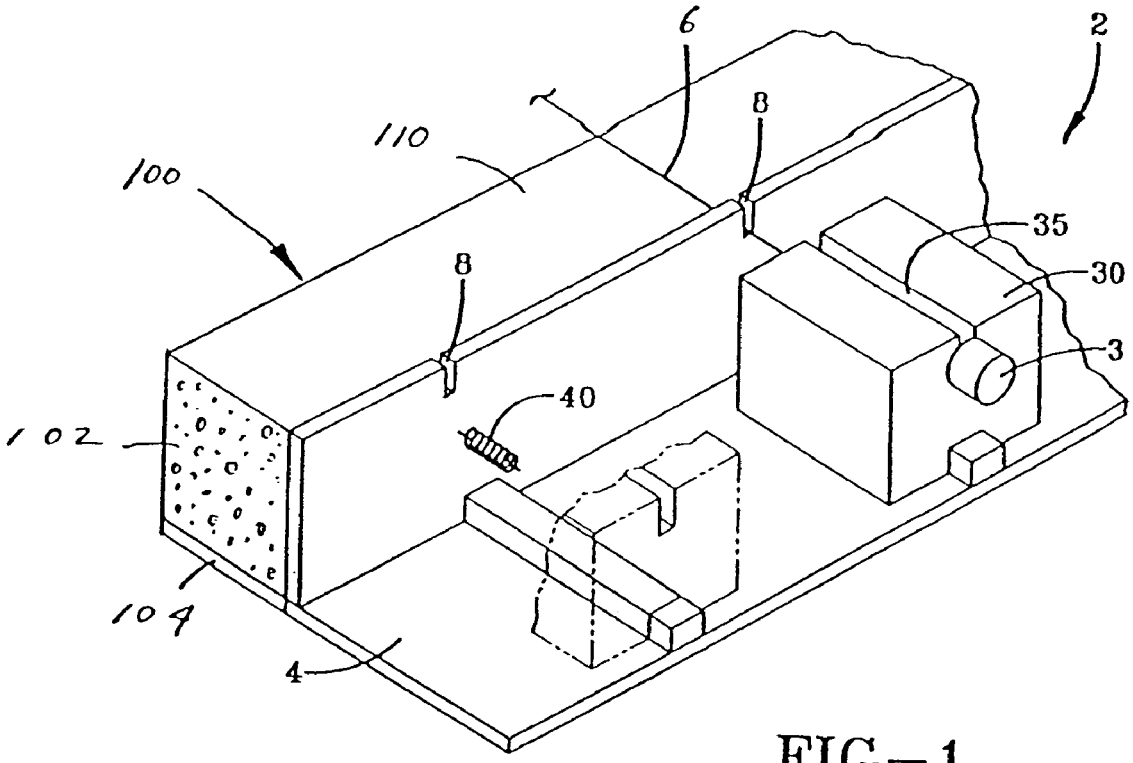
FIG. 1 presents a perspective view of a corona wire apparatus and damping pad according to one aspect of the invention.

Various aspects of the invention are presented in FIGS. 1–5, which are not drawn to scale, and wherein like components in the numerous views are numbered alike. Referring now to FIG. 1, a wire tensioning mechanism 2 for tensioning a corona wire 6 in a charger body 4 is presented, in combination with a corona wire damper 100, according to one aspect of the invention. The corona wire 6 has an attachment 3 at one end and is fixed to the charger body 4 at the end, for example by a lug. The mechanism 2 also comprises a slide block 30, and a spring 40. The charger body 4 may be attached or attachable to an electrographic machine.

The corona wire damper 100 comprises a damping pad 102 and a pad holder 104 that holds the damping pad 102, and is mounted proximate the terminal end of at least one corona wire 6. The damping pad 102 defining an exposed surface 110 that extends along the at least one corona wire 6 in contact therewith. The damping pad 102 is attachable to the charger body 4 and removable therefrom. According to a preferred embodiment, the damping pad 102 is formed of a cellular foamed elastomer that is square in cross section, and can be rotated to present multiple fresh surfaces to the wires. However, other cross-sections are possible, including triangular, rectangular, round, elliptical, etc., without limitation. The pad may also be moved in a lateral direction relative to the wires to present new surfaces. The density of the foamed elastomer may be on the order of 12 to 28 pounds/cubic foot, with a density on the order 24 pounds/cubic foot being a presently preferred embodiment.

The pad material is preferably tolerant of high voltages on the wire (in excess of 18 kv for some applications) and the presence of concentrated levels of ozone and NOx species. A foamed silicone elastomer has been found to be an excellent material, although other elastomers may be used having suitable ozone resistance, NOx resistance, dielectric properties, and temperature resistance, for use proximate a corona wire. The pad holder 104 contains the damping pad 102 and is easily slipped over a feature in the charger body 4. The holder/pad assembly 102/104 may be secured in place by the charger body 4 and the corona wires 6.

In a certain embodiment, the damping pad 102 is a 0.25 inch square by about 2 inches long foamed silicone elastomer, 24 pounds/cubic foot, catalog number HT-820 BISCO Cellular Silicone available from Rogers Corporation of Elk Grove Village, Ill. Manufacturer's properties of the HT-820 foam are listed on Table 1. The damping pad 102 engages the corona wire 6 (is compressed) 0.030 inch+/−0.030 inch. Thus, mere contact has been found to damp vibrations in the corona wire 6.

TABLE 1

| Property | Test Method | Performance |
|---|---|---|
| Compression Force Deflection, psi (kpa) @ 25% Deflection | ASTM D-1056 | 14 (97) |
| Compression Set @ 70° C. (158° F.) | ASTM D-1056 | <1% |
| Compression Set @ 100° C. (212° F.) | ASTM D-1056 | <5% |
| Density, pounds/cubic foot (kilograms/cubic meter) | ASTM D-3574 | 24 (384) |
| Tensile Strength, psi (kpa) | ASTM D-412 | 60 (414) |
| Elongation, % | ASTM D-412 | 65 |

TABLE 1-continued

| Property | Test Method | Performance |
|---|---|---|
| Water Absorption | ASTM D-570 | 0.8% |
| UV Resistance | SAE J-196 | No Degradation |
| Ozone Effect Rating | ASTM D-1171 | 0 (No Cracks) |
| Stain Resistance | ASTM D-925(A) | No Staining |
| Corrosion Resistance | AMS-3568 | Pass |
| Flame Resistance | UL94 | HBF (Listed) |
| Flame Spread Index (Is) | ASTM E-162 | <25 |
| Limiting Oxygen Index (LOI) | ASTM D-2863 | 42% |
| Smoke Density ($D_x$) @ 4.0 Minutes | ASTM E-662 | <50 |
| Smoke Density ($D_x$) @ 1.5 Minutes | ASTM E-662 | <20 |
| Toxic Gas Emissions Rating | SMP-801 & BSS | Pass |
| Weight Loss After 168 Hours @ 135° C. | ASTM D-573 | 0.8% |
| Dielectric Constant | ASTM D-149 | 1.50 |
| Dielectric Strength (Volts/mil) | ASTM D-150 | 93 |
| Dry Arc Resistance (Seconds) | ASTM D-495 | 96 |
| Volume Resistivity (Ohm-cm) | ASTM D-257 | $10^{14}$ |
| Thermal Conductivity (BTU in./hr/sq. ft./° F.) (Wm/° K.) | ASTM C-518 | 0.75 0.11 |
| Hot Flex @ 230° C. | ASTM D-573 | Pass |
| Low Temperature Embrittlement | ASTM D-746(B) | −67° F. (−55° F.) |
| Recommended Use | SAE J-2236 | −67° F. to 392° F. (−55° C. to 200° C.) |
| Recommended Intermittent High Temperature Use | Rogers Internal | 482° F. (250° C.) |

In the embodiment presented, the slide block 30 is slidably mounted to the charger body 4 at an end 7 of the wire, such that the slide block 30 slides parallel to the wire 6. The slide block 30 has a slot 35 which is wider than the wire 6 but narrower than the attachment 3, such that when the slide block 30 is mounted on the charger body 4. The wire end 7 is slidable within slot 35 such that pulling the slide block 30 in the direction away from the wire 6 forces the attachment 3 against the slot 35, but does not allow the attachment 3 to pass through. The slot 35 is lined up with the wire 6 such that when the wire 6 is in tension, there are no side loads on the attachment 3. In a preferred embodiment, the attachment 3 is a lug crimped on the wire end 7.

In order to align the wire 6 in a desired direction, the charger body 4 may comprise grooves 8, and the corona wire 6 lays in a corresponding groove. In such case, the slide block 30 is preferably slightly offset from the groove 8 in order to register the wire 6 against the groove 8, which inhibits movement of the wire 6.

The spring 40 is mounted between the charger body 4 and the slide block 30 such that the spring 40 exerts a force on the slide block 30 in the opposite direction of the force which the tensioned wire 6 exerts on the slide block 30. The force of the spring 40 can cause the slide block 30 to slide, and the spring 40 is chosen such that the force exerted on the slide block 30 causes the wire 6 to achieve the desired tension. Thus the spring 40 forces the slide block 30 to pull on the wire 6.

Figure 2:
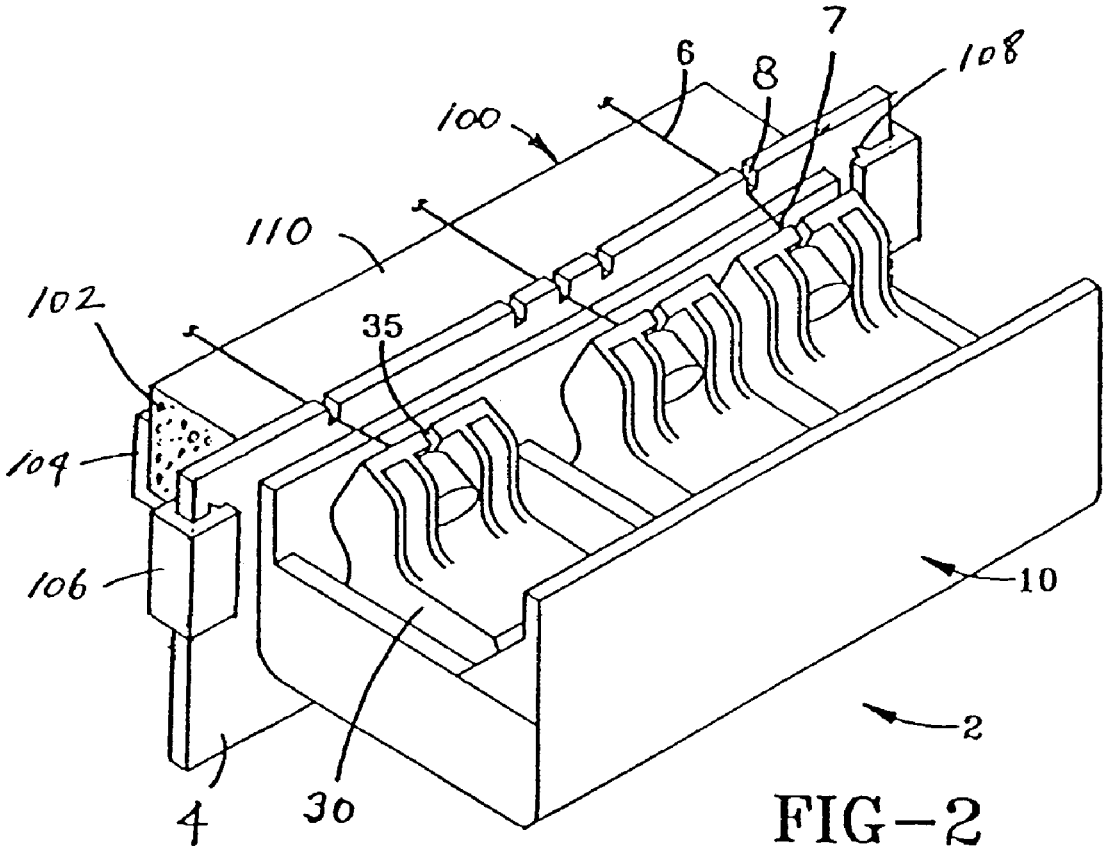
FIG. 2 presents a perspective view of a corona wire apparatus and damping pad according to a further aspect of the invention.
Figure 3:
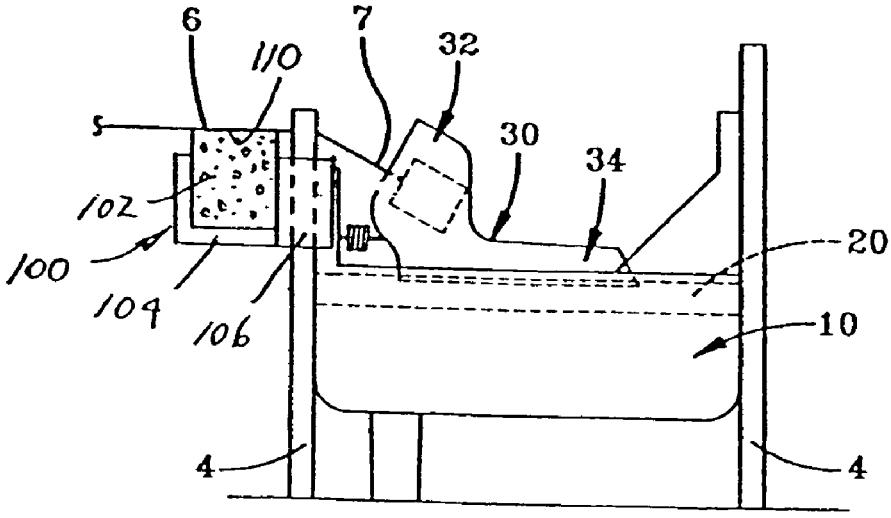
FIG. 3 is a side view of the corona wire apparatus and damping pad of FIG. 2.
Figure 4:
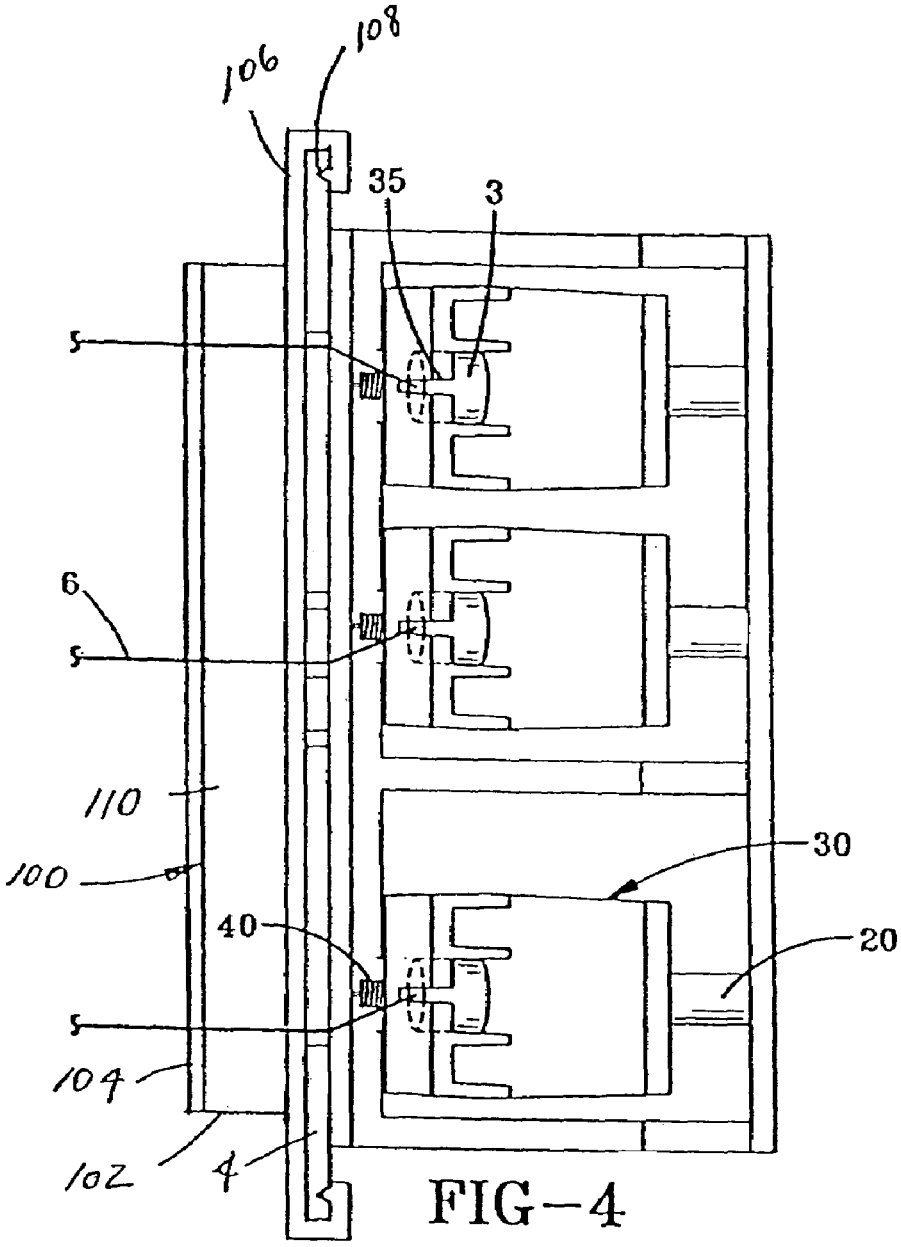
FIG. 4 is a top view of the corona wire apparatus and damping pad of FIG. 2.

Referring now to FIGS. 2–4, a further embodiment is presented, wherein the pad holder 104 comprises a pair of laterally spaced arms 106 configured to engage the charger body 4 by wrapping around a mating portions on the charger body 4. The pad holder 104 is removable. Each arm may comprise a protuberance 108 that helps register and retain the corresponding arm 106 to the charger body 4. The charger body 4 may comprise a mating hole or ledge that engages the protuberance 108. The arms 106 preferably form a integral part with the pad holder 102, for example, as a one-piece plastic molding, and the protuberance 108 may be shaped as a ridge.

The pad holder 104 preferably exhibits environmental resistance similar to the damping pad 102. The pad holder 104 may formed from the same material as the charger body 4, for example molded polyphenylene oxide (PPO). In a certain embodiment, the pad holder 104 is formed from Noryl® N190X PPO available from GE Plastics of Pittsfield, Mass.

The wire tensioning mechanism 2 may further comprise a wire holder 10 which is mounted to the machine 4. In this embodiment, the slide block 30 is slidably mounted to the wire holder 10. A preferred means of slidably mounting the slide block 30 to the wire holder 10 is to use a slide pin 20, wherein the slide pin 20 is mounted to the wire holder 10. A slide pin 20 may be mounted directly to the charger body 4, wherein the slide block 30 is slidably mounted to the charger body 4 on the slide pin 20 (see FIG. 1).

When a wire holder 10 is incorporated, the spring 40 may be mounted between the charger body 4 and the slide block 30 or between the wire holder 10 and the slide block 30 (see FIGS. 2–4). The preferred embodiment is to have the spring 40 mounted between the slide block 30 and the wire holder 10.

The slide block 30 may be v-shaped, and the v-shaped slide block 30 comprises a first leg 34 and a second leg 32 (this is best seen in FIG. 3). The first slide block leg 34 is slidably mounted to the charger body 4, and the second slide block leg 32 is on the same side of the first leg 34 as the wire 6 such that the second leg 32 angles away from the wire 6. Thus the "v" is laying on one of its sides (first leg 34), and the slot 35 is in the other side of the "v" (second leg 32). The portion of the slide block 30 with the slot 35 angles away from the wire 6 in order to better keep the wire 6 from slipping out of the slot 35.

The spring 40 may be a compression spring. Although a compression spring is preferred for space constraint reasons, a tension spring will also work.

In a typical electrographic machine, multiple corona wires are present.

Figure 5:
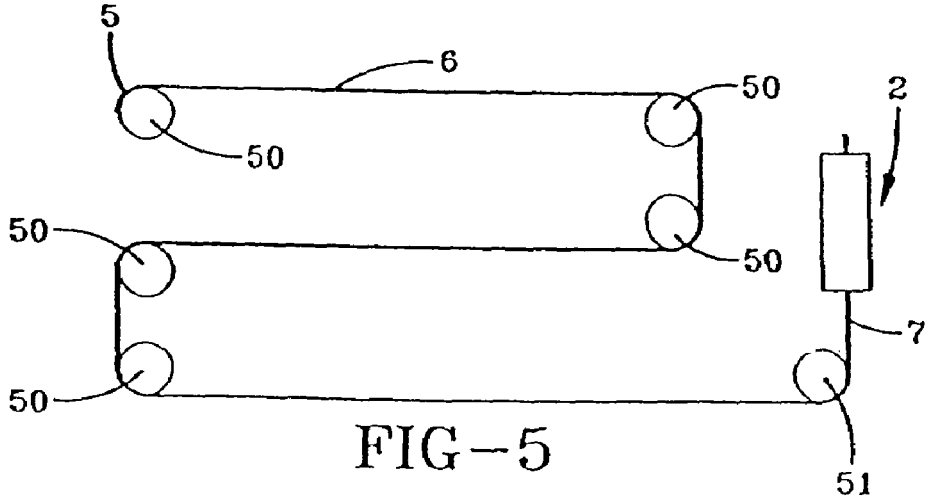
FIG. 5 is a top view of a continuous corona wire configuration that may be implemented in the practice of the invention.

Referring now to FIG. 5, rather than have individual wires, a single continuous wire 6 may be used which would be strung in such a way as to create multiple segments. This continuous wire 6 would have a first end 5 and a second end 7, wherein the first end 5 is secured against movement and the second end 7 has a lug 3 crimped on. The bends in the wire are achieved by wrapping the wire 6 around restraining devices 50, the second end 7 is wrapped around a final restraining device 51 such that it makes an angle with the rest of the wire 6 of approximately 90°. The second end 7 is then secured by a wire tensioning mechanism of the type described above. Many different types of restraining devices are acceptable; posts, pins, pulleys and grooves are all examples of restraining devices which may be used. However this invention is not limited to these specific examples, any device which acts to restrain the wire such that the wire may be bent into multiple segments may be used.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A corona wire damper for damping at least one corona wire mounted at a terminal end to a charger body, comprising:

a damping pad; and, a pad holder holding said damping pad and attachable to the charger body such that said damping pad contacts the at least one corona wire proximate the terminal end;

wherein said pad holder comprises a pair of arms configured to engage mating portions of the charger body, and each arm comprises a protuberance.

2. A corona charger for an electrographic printer, comprising:

a charger body;

at least one corona wire mounted at a terminal end to said charger body;

a damping pad; and, a pad holder holding said damping pad and attached to said charger body such that said damping pad contacts said at least one corona wire proximate the terminal end;

wherein said pad holder comprises a pair of arms wrapping around mating portions of said charger body, and each arm comprises a protuberance that engages a mating structure on said charger body.

3. A method for damping at least one corona wire mounted at a terminal end to a charger body in an electrographic printer, comprising:

contacting said at least one corona wire with a damping pad proximate the terminal end;

further comprising rotating said damping pad to contact a fresh surface of said pad with said at least one corona wire.

4. A method for damping at least one corona wire mounted at a terminal end to a charger body in an electrographic printer, comprising:

contacting said at least one corona wire with a damping pad proximate the terminal end;

further comprising moving said damping pad laterally relative to said at least one corona wire to contact a fresh surface of said pad with said at least one corona wire.

5. A method for damping at least one corona wire mounted at a terminal end to a charger body in an electrographic printer, comprising:

contacting said at least one corona wire with a damping pad proximate the terminal end;

further comprising holding said damping pad in a pad holder having a pair of arms, and registering said pad holder to said charger body with a protuberance formed in each arm.

* * * * *